United States Patent [19]

Rand et al.

[11] Patent Number: 4,631,741

[45] Date of Patent: Dec. 23, 1986

[54] BEAM SPOT MONITORING ARRANGEMENT FOR USE IN A SCANNING ELECTRON BEAM COMPUTED TOMOGRAPHY SCANNER AND METHOD

[75] Inventors: Roy E. Rand, Palo Alto; John L. Couch, San Francisco, both of Calif.

[73] Assignee: Imatron, Inc., San Francisco, Calif.

[21] Appl. No.: 597,133

[22] Filed: Apr. 5, 1984

[51] Int. Cl.[4] ..... H05G 1/52; H01J 35/30; H01J 35/14

[52] U.S. Cl. ..... 378/10; 378/16; 378/113; 378/137; 378/138

[58] Field of Search ..... 250/491.1; 378/10, 12, 378/16, 19, 205, 113, 137, 138

[56] References Cited

U.S. PATENT DOCUMENTS

| | | | |
|---|---|---|---|
| 2,946,892 | 7/1960 | Bas-Taymaz | 378/137 |
| 4,075,489 | 2/1978 | Neal et al. | 378/10 |
| 4,112,397 | 9/1978 | Randall | 378/12 |
| 4,123,659 | 10/1978 | Oliver | 378/12 |
| 4,158,142 | 7/1979 | Haimson | 378/137 |
| 4,160,909 | 7/1979 | Froggatt | 378/12 |
| 4,211,925 | 7/1980 | Fairbairn | 378/113 |
| 4,329,585 | 5/1982 | Gillard | 378/113 |
| 4,352,021 | 9/1982 | Boyd et al. | 378/12 |
| 4,521,901 | 6/1985 | Rand | 378/138 |

*Primary Examiner*—Craig E. Church
*Assistant Examiner*—Charles Wieland
*Attorney, Agent, or Firm*—Flehr, Hohbach, Test, Albritton & Herbert

[57] ABSTRACT

A scanning beam computed tomography scanner is disclosed herein and includes means defining a vacuum chamber, means for producing an electron beam at one location in the chamber and for directing it to a second location therein, a target of the type which produces X-rays as a result of the impingement thereon by the electron beam, and means for focusing the beam onto the target in the form of a beam spot and for scanning the beam spot across the target along a particular scan path in order to produce X-rays. The specific scanner disclosed also includes an arrangement for monitoring the profile, position and orientation of the beam spot at a plurality of different points along the scan path.

14 Claims, 7 Drawing Figures

Figure 1:
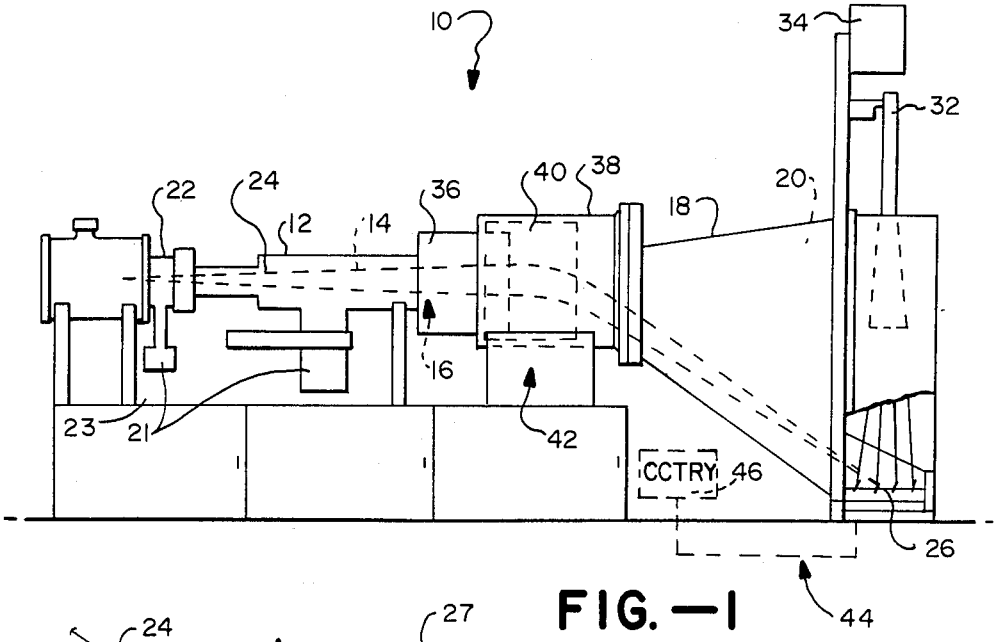

BEAM SPOT MONITORING ARRANGEMENT FOR USE IN A SCANNING ELECTRON BEAM COMPUTED TOMOGRAPHY SCANNER AND METHOD

The present invention relates generally to a scanning electron beam computed tomography scanner in which an electron beam is caused to scan across a target for producing X-rays and more particularly to a technique for controlling the shape and position of the electron beam as it impinges the X-ray producing target.

As will become apparent hereinafter, the present invention is especially suitable for use with the scanning electron beam computed tomography scanner disclosed in copending Rand U.S. patent application Ser. No. 471,199, filed Mar. 1, 1983 and entitled SCANNING ELECTRON BEAM COMPUTED TOMOGRAPHY SCANNER WITH ION AIDED FOCUSING, now U.S. Pat. No. 4,521,902, and Ser. No. 500,136, filed June 1, 1983 and entitled SCANNING ELECTRON BEAM COMPUTED TOMOGRAPHY SCANNER WITH DIFFERENTIAL FOCAL STRENGTH ELECTRON BEAM OPTICS which have been assigned to the assignee of the present application. The scanner disclosed in this application includes means defining a vacuum chamber, means for producing an electron beam at one location in the chamber and for directing the beam to a second location therein, and an elongated target (also located within the chamber) of the type which produces X-rays as a result of the impingement thereon by the electron beam. In addition, this scanner includes an arrangement for causing the electron beam to scan along the length of the target so as to impinge on the latter and thereby cause X-rays to be produced at and emanate from the target. A particular scan arrangement disclosed in the Rand applications includes means for causing the electron beam to converge less in one plane than in an orthogonal plane, thus producing a beam spot (the cross section of the beam at its point of impingement with the target) which is generally elliptical in configuration. The means for producing this differential convergence of the electron beam includes a focusing mechanism acting on the electron beam in order to focus it to a spot on the target, specifically a mechanism displaying a greater focal strength in one plane of the beam, at any instant along its scan path, then in the orthogonal plane at that instant. In this way, the focusing mechanism can be operated so that the beam spot displays this same fixed elliptical configuration at all points along the scan path. This is important to the operation of the overall scanner.

In view of the foregoing, it is the general object of the present invention to provide an uncomplicated and yet reliable way of insuring that the beam spot discussed immediately retains a specific desired configuration (and orientation) at all points along its scan path.

Another general object of the present invention is to provide an uncomplicated and yet reliable way of insuring that this same beam spot is caused to move across a specific desired scan path.

A more particular object of the present invention is to provide a scanning electron beam computed tomography scanner having uncomplicated and yet reliable means for monitoring the actual profile of the beam spot and its position and orientation on the X-ray producing target forming prt of the scanner at a plurality of different points along its scan path in order to determine if the actual profile of the beam spot and its position and orientation on the X-ray producing target conform to the desired profile of the beam spot and its position and orientation at these various points.

Another specific object of the present invention is to provide a beam spot monitoring technique which is especially suitable for monitoring beam spots which are intended to be elliptical in configuration and oriented in a particular way relative to the scan path.

As will be described in more detail hereinafter, the specific beam spot monitoring arrangement disclosed herein includes an electron beam intercepting mechanism at a plurality of monitoring points along a first scan path immediately in front of the X-ray producing target. Each of these mechanisms is designed to produce an electrical signal upon impingement by the beam such that the configuration of this signal varies with the shape of the beam spot and its position and orientation when it impinges the mechanism, whereby the signal can be used (1) to monitor the profile of the beam spot and its position and orientation along the scan path and (2) as a means providing information for correcting any errors in the beam spot's profile, position and/or orientation. A different electron beam intercepting mechanism is located at each end of a second scan path which parallels the first path and which is otherwise free of electron beam intercepting arrangements. The electron beam acts on the first scan path which serves as a monitoring path for establishing the beam spot profile (e.g. providing the necessary focusing of the spot at each monitoring point) and its position and orientation (e.g. the proper alignment at each point) and then the beam is shifted radially to the second scan path which serves as an operating path for producing X-rays. The beam intercepting mechanisms at opposite ends of the second path monitor the radius of this path in order to determine if this shift has been accurately made.

The overall monitoring technique discussed briefly above will be described in more detail hereinafter in conjunction with the drawings wherein.

Figure 1A:
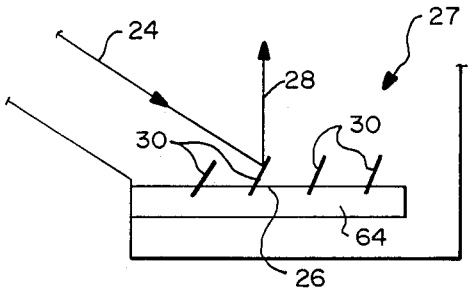
Figure 2:
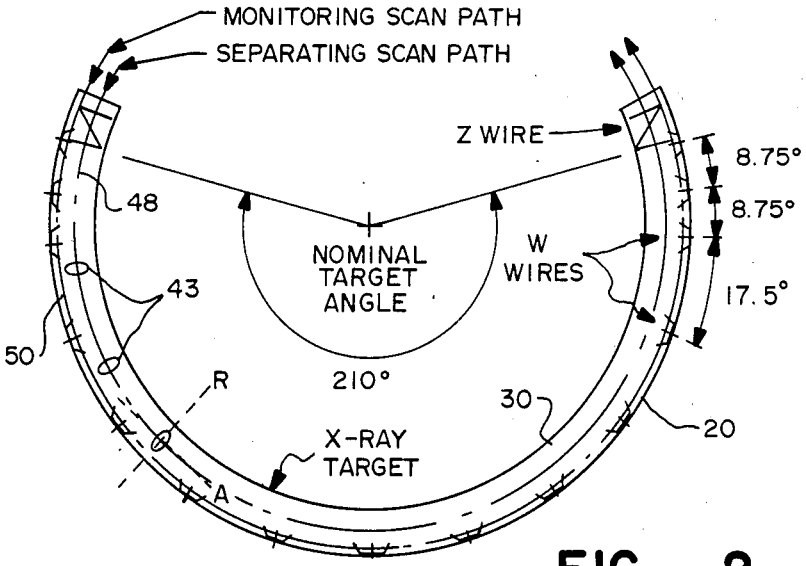
Figure 3:
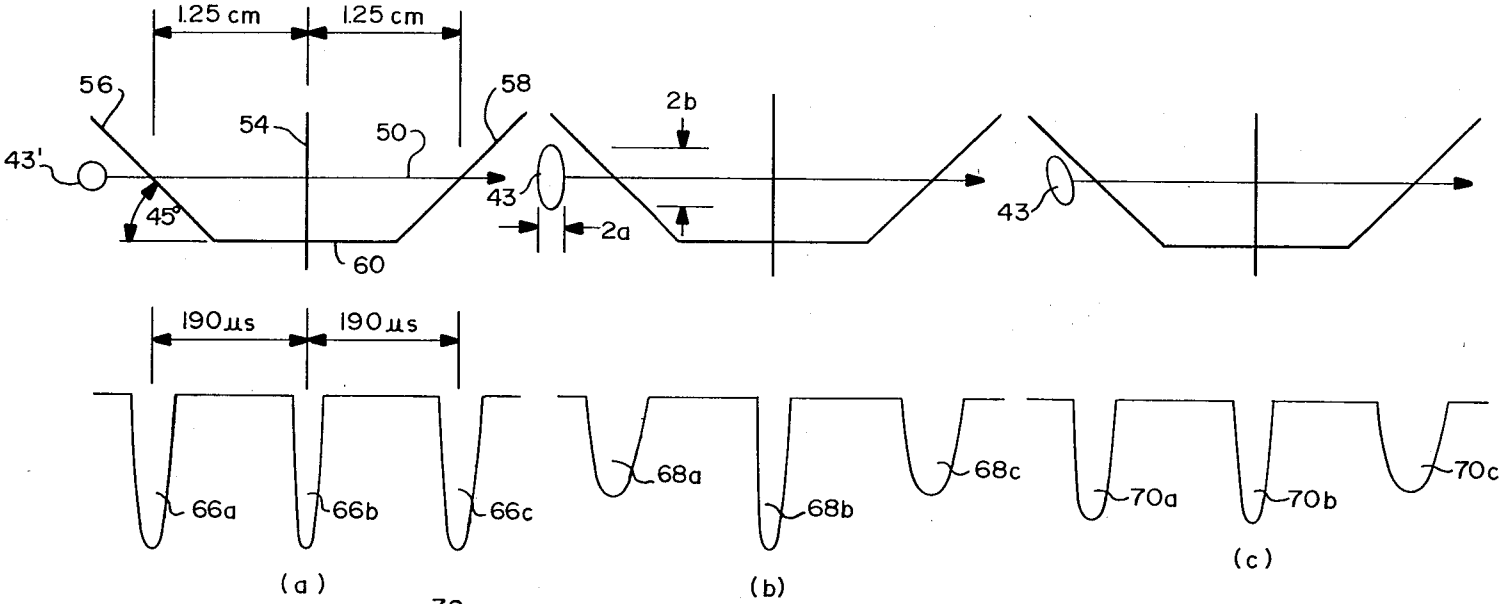
Figure 5:
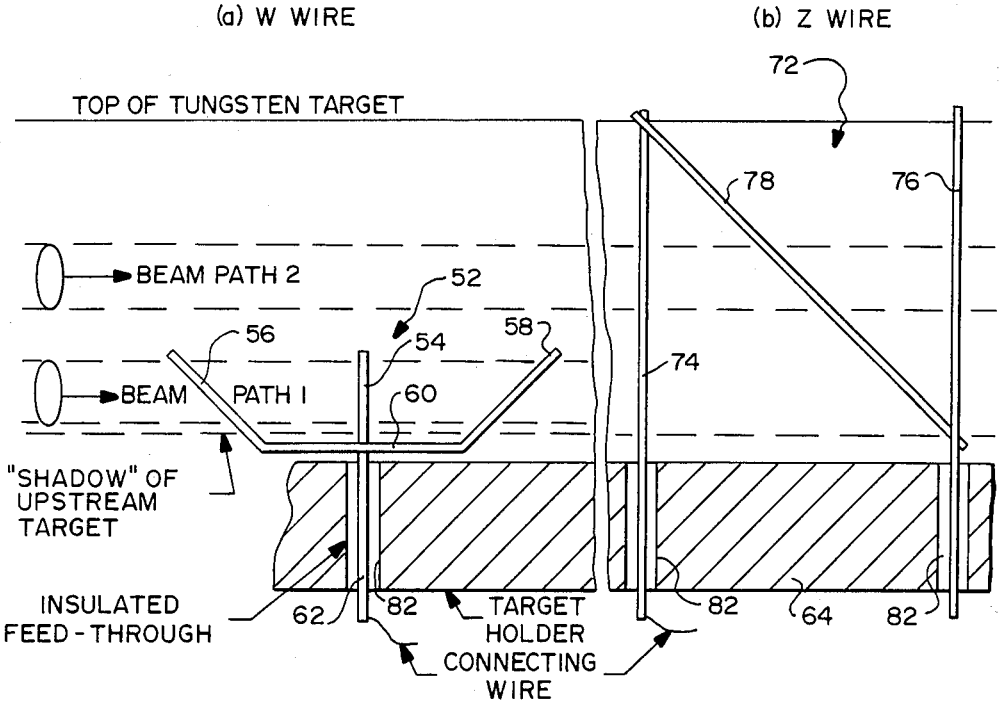
Figure 6:
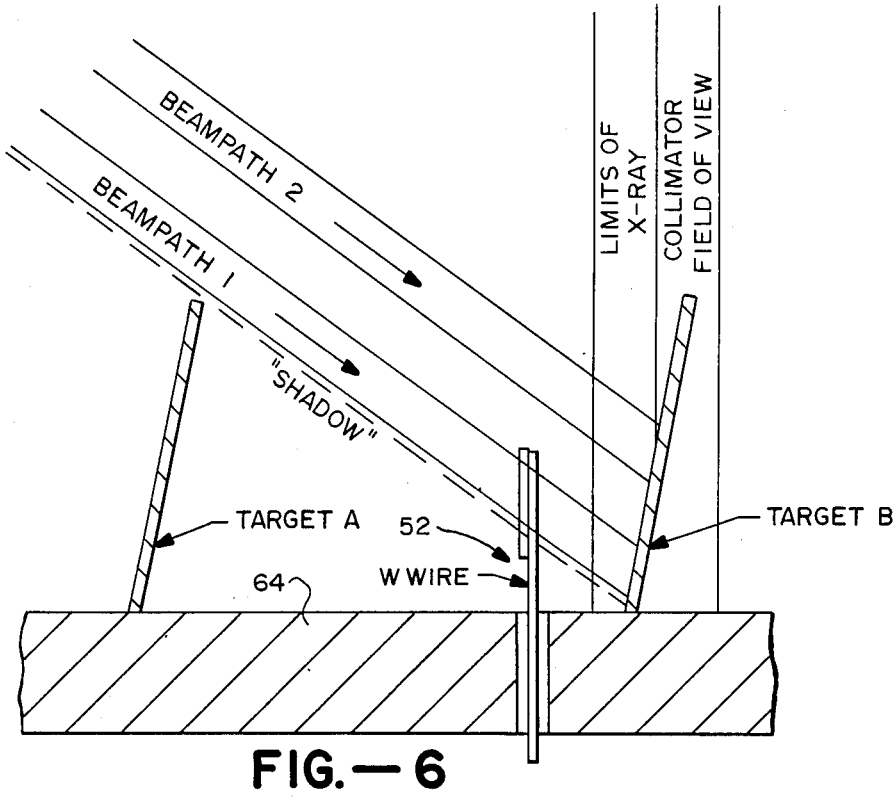

FIG. 1 diagrammatically illustrates a scanning electron beam computed tomography scanner including a beam spot monitoring arrangement designed in accordance with the present invention;

FIG. 1A diagrammatically illustrates an X-ray producing target assembly forming part of the scanner of FIG. 1;

FIG. 2 diagrammatically illustrates in end elevational view one of the targets forming part of the overall target assembly of FIG. 1A including specifically a plurality of electron beam intercepting mechanisms forming part of the overall beam spot monitoring arrangement of the present invention;

FIGS. 3A, 3B, 3C, and FIG. 4 diagrammatically illustrate the beam intercepting mechanisms of FIG. 3 and associated electrical signals which vary with the way in which the beam impinges on these mechanisms;

FIG. 5 diagrammatically illustrates two specific types of electron beam intercept mechanisms and the way in which they are structurally supported to a target forming part of the overall assembly of FIG. 1A; and FIG. 6 is a side elevational view of a section of the target assembly of FIG. 1A, particularly illustrating the positional relationship between adjacent targets and a particular electron beam intercepting arrangement.

Turing now to the drawings, attention is first directed to FIG. 1 which illustrates a scanning electron beam computed tomography scanner designed in accordance with the present invention and generally indicated by the reference numeral 10. With the exception of the present invention which will be discussed below, scanner 10 may be identical to the one described in the previous Rand patent applications and U.S. Pat. No. 4,352,021 (Boyd et al) which was cited in these latter applications.

As illustrated in FIG. 1, scanner 10 includes means generally indicated at 12 for defining one section 14 of a vacuum chamber 16, means generally indicated at 18 for defining a second section 20 of the same chamber, and a vacuum pump 21 acting on the chamber. Means including an electron gun 22 and its own vacuum pump 23 located at the rearwardmost end of chamber 16 serves to produce an electron beam 24 which is directed horizontally in a continuously expanding fashion through chamber section 14 to the forwardmost end of the latter where it is acted upon in the manner to be discussed hereinafter. The cross section of electron beam 24 between electron gun 22 and the forwardmost end of chamber section 14 is circular in configuration.

As illustrated in FIG. 1, means 18 defining chamber section 20 is configured to define a somewhat cone-shaped chamber section, at least to the extent that it tapers downward and outward from chamber section 14. At the forwardmost end of this chamber section, scanner 10 includes an assembly 27 of targets of the type which produce X-rays 28 (see FIG. 1A) as a result of the impingement thereon by electron beam 24. A typical target 26 is generally arcuate in form (see FIG. 2) and extends around the inside of chamber section 20 at its forwardmost end. As best seen in FIG. 1A, the targets form a series of stepped surfaces 30 which extended the entire length of the targets and which face the rearwardmost end of chamber section 20 in order to intercept and, as a result, be impinged by electron beam 24 for producing a resultant X-ray beam 28. The way in which electron beam 24 is directed onto target surfaces 30 does not form part of the present invention and reference is made to the Rand applications. Surfaces 30 are angled relative to the incoming electron beam to reduce the axial width of the effective focal spot of the resultant X-ray beam and to direct the X-ray beam upward through a patient (not shown) to one of a number of detectos 32. Overall operation of the scanner is controlled by computer processing means partially indicated at 34.

The components making up overall scanner 10, as described thus far, form part of the previously recited Boyd et al patent and/or the Rand patent applications and therefore will not be described herein. Rather, reference is made to the Boyd et al patent and the Rand patent application. In this regard, it should be noted that scanner 10 may include other components (not disclosed herein) which do not form part of the present invention but which are necessary or desirable to operation of the overall scanner. For a discussion of these components, reference is again made to the Boyd et al patent and the Rand patent application.

In addition to the components thus far described, scanner 10 includes a solenoid coil 36 and an assembly of dipole coils 38, the latter containing a set of magnetic quadrupole coils 40. These three components are combined to provide an overall focusing and scanning arrangement 42 at the forwardmost end of chamber section 16 and the rearwardmost end of chamber section 20 for focusing beam 24 onto and causing it to scan along the length of any given one of the targets 26 to cause X-rays 28 to be produced by and emanated from the target. As described in detail in the Rand applications, the cross section of electron beam 24 at its point of impingement with the target (e.g., the beam spot) is generally elliptical in configuration and is intended to be fixed in size and in radial position (laterally) at all points along the length of the target. Moreover, the orientation of the beam spot at any given point on the target is intended to be fixed relative to the scan path. This is best illustrated in FIG. 2 where the beam spot (indicated at 43) is shown at different points on surface 30 of a target 26.

In the embodiment illustrated, the major axis of the elliptical beam spot 43 is always normal to its scan path, that is, its major axis always extends in the radial direction R while its minor axis always extends in the aximuthal direction A, as illustrated in FIG. 2. This is accomplished by means of quadrupole coils 40 in combination with the dipole coils to focus the electron beam to a spot on the target utilizing differential focal strength beam optics, as described more fully in the above-recited Rand patent applications.

Having described the way in which elliptical beam spot 43 is produced on target 26, attention is now directed to an arrangement generally indicated at 44 in FIG. 1 for monitoring the actual profile, position and orientation of the beam spot on the target and for insuring that all three conform to the desired profile, position and orientation of the beam, respectively. To this end, arrangement 44 includes a series of electron beam intercepting mechanisms or devices at various points immediately in front of the target, each of which is designed to produce an electrical signal upon impingement by the beam such that the configuration of this signal varies with the profile of the beam, its position and its orientation when the beam impinges the mechanism. These signals are in turn processed by suitable circuitry generally indicated at 46 (labeled CCTRY) and directed to an oscilloscope which is used by the operator for making any corrections necessary to the electron beam in order to maintain the desired beam spot profile, position and orientation.

In a preferred embodiment of the present invention, each target 26 includes two parallel scan paths extending the length of the target, a radially inner path 48 and a radially outer path 50, as seen in FIG. 2. While not shown, means are included for acting on the electron beam such that the beam spot 43 shifts radially between these two paths. The scan path 48 serves as an operating scan path in that X-rays 28 are produced from this path in the direction of a patient while path 50 serves as a monitoring scan path in that the beam spot is focused, positioned and aligned (that is monitored for the proper profile, position and orientation) at each of these points.

As indicated above, overall monitoring arrangement 44 includes a number of electron beam intercepting devices. One such device is illustrated in FIGS. 5 and 6 at 52. This device is in the form of a generally W-shaped electrically conductive wire, preferably a tungsten wire, having three spaced apart straight segments, a central segment 54 and opposite end segments 56 and 58 which extend outward and away from the central segment. The two outer segments are joined by a common base segment 60 which, in turn, is welded to the central segment, the latter being joined by a connecting wire 62. A number of these devices are located along monitoring scan path 50 immediately in front of an associated target 26, as best seen in FIG. 2. As seen in FIGS. 5 and 6, these devices are supported on a base 64 forming part of the target assembly 27. Connecting wires 62 extend through cooperating insulated passage ways in the base and ultimately to circuitry 46 (see FIG. 1). As best illustrated in FIG. 5, straight segment 54 of each monitoring device 52 extends across scan path 50 in a direction normal to the path while the end segments 56 and 58 extend across the same path at angles therewith, specifically at 45° angles in the embodiment illustrated. At the same time, the base segment 60 is positioned out of the scan path 50.

The principle of operation of device 52 is best illustrated in FIGS. 3A, 3B and 3C where oscilloscope traces for various beam spot configurations are shown. More specifically, as stated above, each device 52 is connected to circuitry 46 via connecting segment 62 and this circuitry includes an oscilloscope responsibe for the traces just mentioned. Each oscilloscope trace corresponds to an electrical signal which is produced as a result of the impingement of an associated device 52 by the electron beam.

Consider firs the case of a circular beam spot 43' shieh is perfectly aligned on monitoring scan path 50, as illustrated in FIG. 3A. The oscilloscope trace shows three pulses 66*a*, 66*b*, and 66*c* of equal height. However, because the outer wire segments 56 and 58 extend across path 50 at 45° angles, the outside pulses 66*a* and 66*c* are $\sqrt{2}$ times the width of central pulse 66*b*. Because the three segments 54, 56, and 58 are fixed in position relative to one another and because the outer segments extend at an angle relative to the central segment, the spatial relationship between the pulses 66 will vary with the radial (lateral) position of beam spot 43 on path 50 (that is, the vertical position of the beam spot as it is viewed in FIG. 3), assuming that the scan speed of the beam spot is fixed. Thus, with the outer segments 56 and 58 disposed at 45° relative to the central segment 54 and with the three segments spaced relative to one another in the manner illustrated, that is, such that a central point on each outer segment is 1.25 cm from the central segment and further assuming a constant scan velocity of 65 m/s, for a perfectly aligned beam, that is, one which moves across the center of the scan path as illustrated in FIG. 3A, the three pulses will be separated by 190 microseconds. If the beam spot crosses device 52 at points further away from base segment 60, the time between pulses will increase and if the beam spot is closer to base segment 60, the time between pulses will decrease. Thus, the operator can utilize this information to act on arrangement 42 for adjusting the electron beam in order to place the beam spot in the center of its scan path. Unequal spacings between the pulses 66 would indicate that the actual scan path taken by the beam spot has a radial component and can be corrected likewise. Moreover, the time of arrival of the beam spot at the device 52, that is the aximuthal (longitudinal) position of the beam spot, can be measured (using a dual-beam oscilloscope) by comparing the pulses 66 for each device 52 with a timing pulse generated by the computer which controls the operation of the overall scanner. Circuitry 46 and computer processing means 34 can comprise such means including the dual beam oscilloscope and means for generating timing pulses. If the timing pulses and pulses 66 are in sync with one another in a predetermined way, the beam spot is at the right place at the right time. In order words, it is in the desired longitudinal position thus, by observing these two types of pulses, the longitudinal position of the beam spot can be monitored.

The foregoing has been a discussion of the way in which a circular beam spot interacts with an electron beam intercepting device 52. While the present invention is compatible with a scanning electron beam having a circular beam spot, the (preferred) scanner also provides a preferred elliptical beam spot, as discussed previously. Moreover, this preferred beam spot has its major axis in the scanners radial direction, that is, pependicualr to the scan path while its minor axis is in the aximuthal direction. The interaction between this beam spot and the same device 52 shown in FIG. 3A is illustrated in FIG. 3B along with corresponding output pulses (oscilloscope traces) 68*a*, 68*b*, and 68*c*. For this example, it is assumed that the beam spot is properly oriented so that its major axis is normal to the scan path and the beam spot is centrally located on the scan path. Further, the minor axis is assumed to be equal to 2*a* while the major axis is assumed to be equal to 2*b*, as illustrated. Therefore, the ratio of the height of each outside pulse 68*a* to inner pulse 68*b* is $\sqrt{2}a/\sqrt{a^2+b^2}:1$, while the width of the inner pulse is a measure of 2*a* and the width of the outer pulses is a measure of $2\sqrt{a^2+b^2}$ in the same units. As in the case of the circular beam spot, if the elliptical beam spot varies laterally (radially) within the scan path, the pulses 68 will either move closer together or further apart.

FIG. 3C shows how the beam intercepting device 52 interacts with beam spot 43 when the latter is incorrectly oriented, that is, skewed counterclockwise as shown. In this case, the first two pulses which are indicated at 70*a* and 70*b* mimic the pulses 66*a* and 66*b* corresponding to the circular beam spot 43' while the third pulse 70*c* is shorter and wider. If the beam spot is skewed in the opposite direction, the pulse 70*a* would be the shorter and wider one.

Returning to FIG. 2, it should be apparent in view of the foregoing that the various devices 52 positioned along scan path 50 in front of target 26 can be used to monitor the profile and position (laterally) of the beam spot on the path and its orientation (assuming a noncircular beam spot) by producing corresponding pulses of the type described by FIGS. 3A–3C. At the same time, these pulses can be used by the operator to correct for errors in the profile of the beam spot, its orientation and its position both laterally and longitudinally (e.g. the beam spots time of arrival at the various devices 52) on the monitoring scan path. After the beam spot is focused, aligned and properly positioned on scan path 50 at each device 52, its path radius is decreased by a known amount at each device in order to define the previously recited operating scan path 48. This latter path is monitored by two generally Z-shaped electron beam intercepting devices 72 which are located at opposite ends of scan path 48 directly in front of the target surface 30. The right hand most one of these devices (as viewed in FIG. 2) is illustrated in FIG. 5. Device 72 is made up of three segments of an electrically conductive wire, preferably a tungsten wire, opposite end segments 74 and 76 and a central segment 78. This device is supported to base 64 in the same manner as the devices 52 with the segments 74 and 76 extending there through in an electrically insulated fashion. One or both of these segments extend to circuitry 46 and the device is thereby connected to the oscilloscope in the same manner as devices 52.

Figure 4:
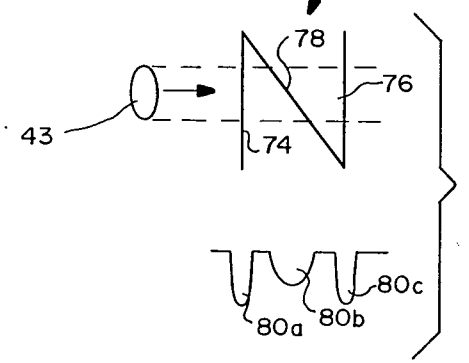

As illustrated both in FIGS. 2 and 5, both of the outer segments 74 and 76 of each of the devices 72 extend across operating scan path 48 in directions normal thereto. At the same time, the central segment extends across the scan path at an angle thereto, specifically at an angle of 45° in the particular embodiment shown. FIG. 4 shows how the beam spot 43 interacts with each of the devices 72. For purposes of illustration, the elliptical spot 43 is shown in FIG. 4 at the proper orientation and the desired location on the scan path (the central location laterally). Under these conditions, three pulses 80*a*, 80*b*, and 80*c* are produced equidistant from one another. If the beam spot is laterally further from base 64 (see FIG. 5) than the desired scan path, then the pulses 80*a* and 80*b* will be closer together than the pulses 80*b* and 80*c*. On the other hand, if the beam spot is closer to base 64, the beam spots 80*b* and 80*c* will be closer than the beam spots 80*a* and 80*b*. If the beam spot is incorrectly oriented, the pulses would change in a manner corresponding to the pulses 70 in FIG. 3.

The foregoing has been a description of an overall beam spot monitoring arrangement generally for use in a scanning electron beam computed tomography scanner. In an actual working embodiment, the electrically conductive wire segments making up devices 52 and 72 are constructed of tungsten wire 0.030 inch in diameter, spot welded together. The segments extending through base 64 are preferably insulated by means of glass or ceramic grommets 82. In the case of the W-shaped devices 52, in order to prevent the base segment of each from being subjected to the electron beam, the base is located outside the beam path. In the case of a multi-target assembly such as assembly 27, those devices 52 having a target in front of them are positioned such that their respective base segments 60 lie within the shadow of the upstream target, as illustrated in FIG. 6. In this regard, while each target can include its own devices 52 and 72, in a preferred embodiment where four targets are provided as in assembly 27, only the second and fourth target (starting from the left in FIG. 1A) include such devices. From the information derived from these devices, the necessary shifts can be made to the electron beam to operate properly across the other targets. FIG. 6 also shows how a device 52 is located well away from the operating scan path 48 and outside the range of X-ray collimators so that should any stray electrons hit the devices 52, the X-rays produced cannot reach the scanner detectors 32.

Electrically, the wire segments making up the devices 52 and 72 are connected in groups and grounded through 50 ohm resistors. Thus, for a beam current of 600 milliamps and assuming a secondary emission coefficient of 0.5 and a beam spot width of 0.080 inch (2 millimeters), the maximum amplitude of the oscilloscope signal is expected to be about 5 volts. In practice this amplitude is reduced by the conductivity of the plasma which is created by the electron beam.

What is claimed is:

1. In a scanning electron beam computed tomography scanner including means defining a vacuum chamber, means for producing an electron beam at one location in said chamber and for directing it to a second location therein, a target of the type which produces x-rays as a result of the impingement thereon by said electron beam, and means at said second location for causing said beam to scan a section of said target in a way which causes it to impinge and form a beam spot on said target along a given scan path and thereby produce x-rays, the improvement comprising means for detecting the entire profile of said beam spot at a plurality of different points along said scan path and for determining if said actual profile conforms to a desired profile of said beam spot at each of said points and, in the case of a desired non-circular beam spot, for determining if the spot detected at each point conforms to a desired orientation, said detecting means also detecting the position of said beam spot on said target laterally and longitudinally relative to the scan path as said spot moves along said path, said detecting means including an electron beam intercepting arrangement at each of said points along said scan path immediately in front of said target, each of said arrangements being designed to produce a plurality of electrical signals upon impingement by said beam such that configuration of said signals vary in shape and temporal positioning, relative to one another with the profile, lateral position and orientation of said beam spot, such that the configuration and temporal positioning of said signals are used to monitor the profile, lateral position and orientation of said beam spot.

2. The improvement according to claim 1 wherein each of said intercepting arrangements includes a generally w-shaped electrically conductive wire having three spaced-apart straight segments which project across said scan path in directions transverse to said path and wherein said plurality of signals includes three such signals.

3. The improvement according to claim 2 wherein the straight segments of said W-shaped wire include a central segment which extends normal to said scan path and two end segments which extend out and away from said central segment.

4. The improvement according to claim 3 wherein the desired profile of said beam spot is elliptical.

5. The improvement according to claim 3 wherein said scanning means includes means for causing said beam to scan a second section of said target in a way which causes it to impinge and form a beam spot on said target along a second scan path parallel to said first path, said improvement including means for monitoring the position of said last-mentioned beam spot at points on opposite ends of said second path.

6. The improvement according to claim 5 wherein said position monitoring means includes an electron beam intercepting arrangement at each of said ends of said path immediately in front of said target, each of said arrangements being designed to produced a plurality of electrical signals upon impingement by said beam such that the shape and positioning of said signals, timewise, relative to one another vary with the lateral position and orientation of said beam spot, the shape of said signal being used to monitor the lateral position and orientation of said beam spot on said second path.

7. The improvement according to claim 6 wherein each of said intercepting arrangements includes a generally Z-shaped electrically conductive wire having three straight segments which project across said second scan path in directions transverse to said second path.

8. The improvement according to claim 7 wherein said straight segments include a central segment which extends across said second path at a 45° angle thereto and opposite end segments which extend across said second path perpendicular thereto.

9. In a scanning electron beam computed tomography scanner including means defining a vacuum chamber, means for producing an electron beam at one location in said chamber and for directing it to a second location therein, a target, and means at said second location for causing said beam to scan a section of said target in a way which causes it to impinge and form a beam spot on said target along a given scan path, the improvement comprising means for monitoring the lateral position of said beam spot at a plurality of different points along said scan path in order to determine if the actual path taken by said beam spot conforms to the desired scan path, said monitoring means including a w-shaped electron beam intercepting arrangement at each of said points along said scan path immediately in front of said target, each of said arrangements being designed to produce three time wise spaced apart electrical signals upon impingement by said beam such that the temporal positions of said signals vary with the lateral position of the beam spot so that the configuration of said signal can be used to monitor the lateral position of the beam spot in its scan path.

10. The improvement according to claim 9 wherein said monitoring means includes means for monitoring the longitudinal position of said beam spot on said scan path.

11. A scanning electron beam computed tomography scanner, comprising:

means defining vacuum chamber;

means for producing an electron beam at one location in said chamber and for directing it to a second location therein;

an elongated target including at least one section of the type which produces x-rays as a result of the impingement thereon by said electron beam;

an arrangement at said second location for alternatively causing said beam to scan said one section of said target in a way which causes the beam to impinge and thereby form a beam spot on said target section along a first scan path for producing x-rays and for causing said beam to scan a second section of said target in a way which causes the beam to impinge and thereby form a beam spot on said second target section along a second scan path;

and means for detecting the entire actual profile and lateral position of said beam spot at a plurality of different points along said second scan path and for determining if the actual profile and lateral position of the beam spot corresponds to a desired non-circular profile and a desired lateral position of said beam spot at each of said points, said detecting means including an electron beam intercepting arrangement at each of said points along said second scan path immediately in front of said second target section, each of said arrangements being designed to produce a plurality of time wise spaced apart signals upon impingement by said beam such that the shape and temporal positions of said signals vary with the profile and lateral position of the beam spot of said second path, such that the shapes of said signals can be used to monitor the profile and lateral position of said beam spot, said plurality of signals including three such signals and each of said intercepting arrangements including a generally w-shaped electrically conductive wire having three spaced apart straight segments which project across said second scan path in directions transverse to said second path so as to produce said signals upon impingement by said electron beam, said straight segments including a central segment which extends normal to said second scan path and to end segments which extend out and away from said central segment.

12. The improvement according to claim 11 wherein said detecting means includes means for detecting the longitudinal position of said beam spot on said second scan path.

13. A scanning electron beam computed tomography scanner according to claim 12 including an electron beam intercepting arrangement located at each end of said first scan path immediately in front of said one target section, each of said last mentioned arrangements being designed to produce a plurality of time wise spaced-apart electrical signals upon impingement by said beam such that the configurations of said signals vary with the lateral position of said beam spot on said first path, whereby the configurations of said signals can be used to monitor the lateral position of said beam spot at opposite ends of said first scan path.

14. A scanning electron beam computed tomography scanner according to claim 13 wherein each of said last-mentioned intercepting arrangements includes a generally Z-shaped electrically conductive wire having three straight segments which project across said first scan path in directions transverse to said first path, said straight segments including a central segment which extends across said first path at a 45° angle thereto and opposite end segments which extend across said first path perpendicular thereto.

* * * * *